United States Patent [19]

Sickels et al.

[11] 4,342,356

[45] Aug. 3, 1982

[54] COMBINED FABRIC HANGING AND PLEATING BRACKET

[75] Inventors: Arthur C. Sickels; Anthony R. Sickels, both of Dayton, Ohio

[73] Assignee: Soundfold, Inc., Dayton, Ohio

[21] Appl. No.: 137,151

[22] Filed: Apr. 4, 1980

[51] Int. Cl.[3] ..... A47H 13/14

[52] U.S. Cl. ..... 160/348; 160/327; 160/404

[58] Field of Search ..... 160/348, 349 R, 327, 160/328, 404

[56] References Cited

U.S. PATENT DOCUMENTS

| | | | |
|---|---|---|---|
| 1,991,156 | 2/1935 | Kahn et al. | 160/348 |
| 3,185,207 | 5/1965 | Humble | 160/348 |
| 3,338,292 | 8/1967 | Goodman | 160/349 |
| 3,683,994 | 8/1972 | Eichenlaub | 160/348 |
| 3,785,426 | 1/1974 | Sperling | 160/349 |

*Primary Examiner*—C. J. Husar
*Assistant Examiner*—C. S. Lieberman
*Attorney, Agent, or Firm*—Biebel, French & Nauman

[57] ABSTRACT

A bracket structure for use in hanging and pleating decorative wall fabrics, providing an elongated flat sheet metal backing strip with a plurality of generally U-shaped cross section extensions formed at uniformly spaced intervals along the length of the strip, a plurality of tabs formed in the strip both in the intermediate flat sections and in the curved portion of the U-shaped extensions for engaging and securing fabric with the outer end portions of the tab having a reversed bend which locks the fabric in position, and a rigid facia strip having the same configuration as the sheet metal backing strip and secured thereto with the fabric between the backing and the facia strips to provide protection for the connection of the fabric to the bracket.

2 Claims, 4 Drawing Figures

COMBINED FABRIC HANGING AND PLEATING BRACKET

BACKGROUND OF THE INVENTION

1. Field of the Invention

The present invention relates to fixtures for holding fabric to walls, and more particularly, to a bracket structure for use in hanging decorative wall fabrics and forming pleats in the fabric.

2. Prior Art

Many devices have been proposed for hanging large sections of draping material for both decorative and soundproofing purposes along the walls of theaters, concert halls and the like. These devices generally include a configuration which produces pleats in the material without the necessity of sewing to form the pleats, but which give the appearance of expensive drapery material so formed. Such a device is disclosed, for example, in Humble U.S. Pat. No. 3,185,207, which is assigned to the assignee of the present invention.

One difficulty associated with many of these prior art devices is that they are vulnerable to vandalism due to individuals sitting next to the installations attempting to remove the fabric from the brackets which hang the material, and in addition, are subject to abrasive wear where the material is hung adjacent walkways, and individuals are able to kick or scuff the material and thus tear it or free it from the hanging brackets. All of this detracts from the appearance of the installations and makes it difficult to repair to its original condition.

SUMMARY OF THE INVENTION

The present invention overcomes the abovedescribed disadvantages and difficulties associated with prior art devices, by providing a bracket structure for use in hanging decorative wall fabrics which provides more positive securement of the fabric to the brackets and provides a protective facia strip of sheet metal or other hard material which overlies and covers the connection of the fabric to the bracket and prevents vandalism or accidental destruction of the fabric due to scuffing.

This advantage is provided by a bracket structure which includes an elongated flat sheet metal backing strip having a plurality of generally U-shaped cross section extensions formed at uniformly spaced intervals along the length thereof and providing intermediate flat sections in a common plane between adjacent extensions for resting against a wall to which the strip is to be secured, and a plurality of holes are defined in the intermediate flat sections for securing the strip to a wall.

A plurality of fabric engaging pointed tabs are formed in the strip extending towards a side edge thereof and are bent outwardly away from the side of the strip which will rest against a wall. Each tab has a reverse bend in an upper portion thereof for better securement of the fabric. Some of the tabs are formed in the extensions adjacent but removed from the corners formed by the intersection of the extensions and intermediate sections, and others of the tabs are formed in the outer portions of the U-shaped extensions.

At least one hole is defined in the curved portion of each U-shaped extension for securing a rigid facia strip thereto. The rigid facia strip extends longitudinally coextensive with the sheet metal backing strip and is matingly formed, including its extensions, to receive the backing strip with an intermediate layer of fabric therebetween. A plurality of holes are defined in the facia strip in registry with the holes in the curved portions of the U-shaped extensions of the backing strip, and pop rivets or the like are inserted in the holes in the curved portions of the extensions of both the backing strip and facia strip for securing the facia strip to the backing strip on top of the fabric.

It is additionally desirable that the interconnection of the facia strip and backing strip be such that the facia strip is laterally offset relative to the backing strip when secured thereto so that a portion of the facia strip extends beyond the fabric and an adjacent edge portion of the backing strip to provide additional protection therefore.

BRIEF DESCRIPTION OF THE DRAWINGS

FIG. 4 is a cross sectional view along line 4—4 of FIG. 1 illustrating the facia strip held in position over the fabric and secured to the backing strip by a "pop rivet" or the like.

DETAILED DESCRIPTION OF THE PREFERRED EMBODIMENT

Figure 1:
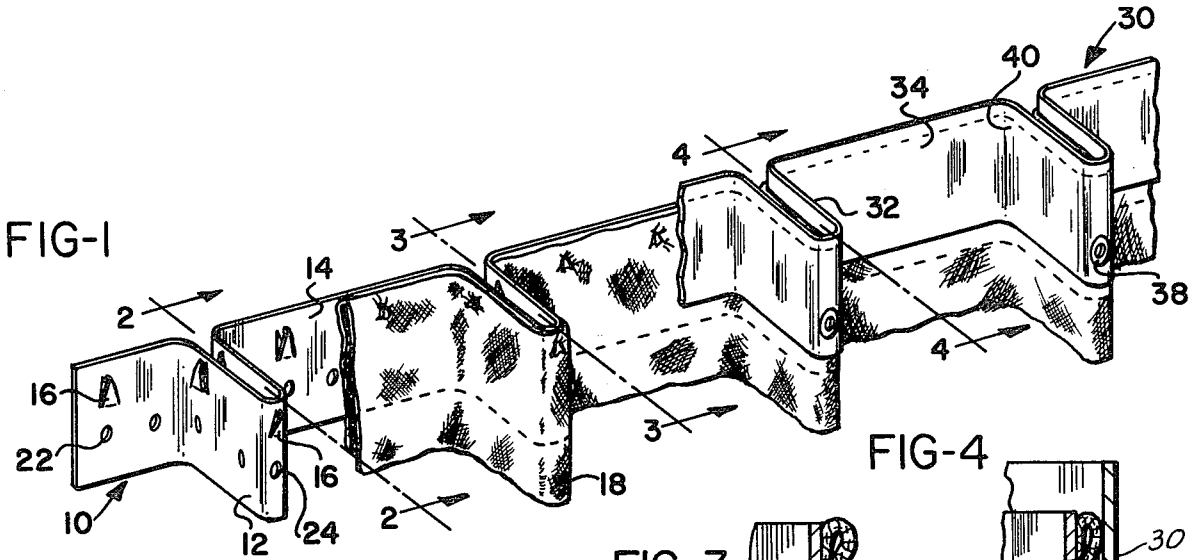
FIG. 1 is a pictorial view, partially cut away, illustrating the facia strip, the drapery fabric, and the backing strip.
Figure 2:
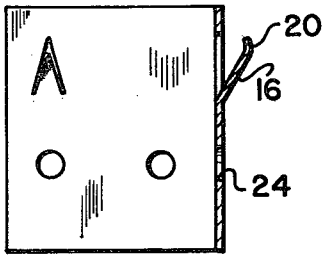
FIG. 2 is a cross section along line 2—2 of FIG. 1 illustrating the reverse bend in the tabs formed in the backing strip.

As illustrated in FIGS. 1 and 2, the backing strip 10 is formed of a single piece of sheet metal comprising a plurality of U-shaped cross section extensions 12 and intermediate adjacent flat sections 14 formed in a common plane, preferably perpendicular to the U-shaped cross section extensions 12. The U-shaped cross section extensions 12 are also preferably formed at uniformly spaced locations along the length of the backing strip 10.

A plurality of tabs 16 are formed in both the U-shaped cross section extensions 12 and intermediate flat sections 14 for the purpose of holding the fabric 18 to the backing strip 10. As best seen in FIG. 2, each tab 16 is bent outwardly away from the intermediate flat sections which engage the wall and is then reverse bent in the upper portion 20 for better gripping the fabric 18 when the tabs are folded inwardly during application of the fabric as described below.

Tabs 16 are formed in the outer curved section of each of the U-shaped extensions 12, and at uniformly spaced locations in the intermediate flat sections 14. In addition, tabs 16 are formed in the leg portions of each of the U-shaped cross section extensions 12 adjacent but spaced outwardly from the corner formed by the intersection of the extensions and the adjacent intermediate flat sections, in order to hold the fabric close to the corner and thereby to produce a sharper pleat fold enhancing the appearance of the fabric installation.

Formed in the backing strip 10 are a plurality of holes 22 which are used to insert screws, nails or the like to secure the backing strip 10 to the wall. In addition, a hole 24 is formed in the outer curved portion of each of the U-shaped cross section extensions 12 for securing the facia strip 30 to the backing strip.

The facia strip 30 is formed of rigid material, such as sheet metal, for mating engagement with the backing strip 10 with an intermediate layer of fabric 18 positioned therebetween. Facia strip 30 includes U-shaped cross section extensions 32 which telescope over extensions 12, and are likewise provided with intermediate flat sections 34 which extend adjacent each intermediate flat section 14, with sufficient clearance for fabric to be positioned therebetween when the structure is assembled.

Figure 4:
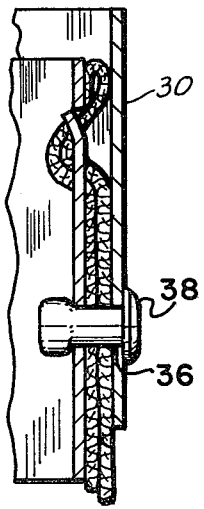

In each of the curved portions of U-shaped extensions 32, a hole 36 is provided in registry with each of the holes 24. A rivet 38, screw or other fastening member can be inserted in these holes through the fabric to secure the facia strip 30 to the backing strip 10. Preferably, however, a "pop rivet" 38 of conventional construction and application is utilized which can be inserted and expanded from the front face of the facia strip 30, as shown in FIG. 4. This provides extremely quick and easy installation when the bracket is already secured to a wall, and yet prevents tampering with the installation as might be possible if more easily removable fasteners were utilized.

In the preferred form, the facia strip 30 has the holes 36 positioned therein in such manner that when secured to the backing strip 10, the facia strip will be offset laterally, for example one-quarter of an inch, in the direction to extend beyond the edge of the fabric 18 secured to the backing strip 10, as shown in FIGS. 1 and 4. This provides additional protection for the fabric as well as a neater appearance.

To install the structure of the present invention, the backing strip 10 is first secured to a wall by inserting nails or screws in the holes 22. It is to be understood that a backing strip 10 is installed along the upper edge of the wall adjacent the ceiling, and a further strip 10 is secured to the bottom edge of the wall adjacent the floor, with the U-shaped extensions 12 of each of these strips in vertical registry so that when the fabric 18 is hung and stretched between the two spaced backing strips, the pleats will be essentially vertical.

Figure 3:
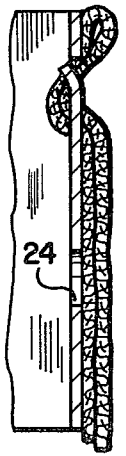
FIG. 3 is a cross sectional view along line 3—3 of FIG. 1 illustrating the fabric held in position by the reverse bent tab.

After the backing strips 10 have been installed, the fabric 18 is hung from the plurality of tabs 16 of the strip installed adjacent the ceiling as well as stretched over the corresponding lower tabs 16 of the strip installed adjacent the floor, which would appear inverted from that as shown in FIG. 1. The tabs 16 are then forced inwardly to capture the material, as shown in FIG. 3, in order to assist in preventing the material from accidentally or purposely being removed from the backing strip without first prying the tabs open. The reverse bend at the top of each tab makes it easier to force the tabs substantially into the plane of the strip for more secure retention of the fabric.

The facia strip 30 is then positioned over the fabric 18 and backing strip 10, and rivets 38 are inserted through holes 24 and 36 which have been positioned in registry. The rivets are then expanded in a well-known manner which then holds the facia strip in position over the fabric and backing strip. The dimension of the strips 10 and 30 are so controlled that in assembled relation, the essentially right angled corners 40 of the facia strip 30 fit sufficiently snugly into the complementary corners of the backing strip 10 as to force the fabric firmly therebetween even though the tabs 16 nearest those corners are spaced appreciably outward therefrom along the extension 12, and thereby to form correspondingly sharp corner bends along the resulting pleats.

Although the foregoing illustrates the preferred embodiment of the present invention, other variations are possible. All such variations as would be obvious to one skilled in this art are intended to be included within the scope of the invention as defined in the following claims.

What is claimed is:

1. A bracket structure for use in hanging and pleating decorative wall fabric, comprising:

an enlarged flat sheet metal backing strip having a plurality of generally U-shaped cross section extensions formed at uniformly spaced intervals along the length thereof and intermediate flat sections in a common plane between adjacent extensions for resting against a wall to which said strip is to be secured, a plurality of holes defined in said intermediate flat sections for securing said strip to a wall, a plurality of fabric engaging pointed tabs formed in said strip to extend toward a side edge thereof and outwardly away from the side of said strip which will rest against a wall to hold fabric on said backing strip while defining pleats therein corresponding to said extensions, some of said tabs being formed in said extensions adjacent but removed from the corners formed by the intersection of said extensions and intermediate sections and others of said tabs being formed in the curved portion of said U-shaped extensions, and at least one hole defined in the curved portion of each U-shaped extension;

a rigid facia strip longitudinally coextensive with said sheet metal backing strip and including U-shaped extensions for telescoping over said backing strip extensions with an intermediate layer of fabric therebetween, a plurality of holes defined in said facia strip in registry with said holes in said curved portions of said U-shaped extensions, said facia strip being laterally offset when secured to said backing strip so that a portion extends beyond the fabric and the adjacent edge of said backing strip; and means insertable in said holes in said curved portions of said extensions of both said backing strip and said facia strip for securing said facia strip to said backing strip with said fabric layer therebetween.

2. A bracket structure as defined in claim 1 wherein an upper portion of each said tab has a reverse bend such that the fabric is penetrated in two separate locations when the tab is bent toward the strip to engage the fabric.

* * * * *